US009970729B1

(12) United States Patent
Coalson et al.

(10) Patent No.: US 9,970,729 B1
(45) Date of Patent: May 15, 2018

(54) ARCHERY ARROW REST ASSEMBLY AND SLIDER THEREFOR

(71) Applicant: TruGlo, Inc., Richardson, TX (US)

(72) Inventors: Damon Coalson, Dallas, TX (US); John Estridge, Garland, TX (US); Alvin R. Wirthlin, Frisco, TX (US)

(73) Assignee: TruGlo, Inc., Richardson, TX (US)

( * ) Notice: Subject to any disclaimer, the term of this patent is extended or adjusted under 35 U.S.C. 154(b) by 0 days. days.

(21) Appl. No.: 14/332,363

(22) Filed: Jul. 15, 2014

Related U.S. Application Data

(60) Provisional application No. 61/846,333, filed on Jul. 15, 2013.

(51) Int. Cl.
*F41B 5/00* (2006.01)
*F41B 5/14* (2006.01)
*F42B 6/04* (2006.01)

(52) U.S. Cl.
CPC ..... *F41B 5/143* (2013.01); *F41B 5/1484* (2013.01); *F42B 6/04* (2013.01)

(58) Field of Classification Search
CPC ..... F41B 5/14; F41B 6/22; F41G 1/467
USPC ..... 124/23.1, 44.5, 88; 43/6; 473/578
See application file for complete search history.

(56) References Cited

U.S. PATENT DOCUMENTS 2,796,691 A 6/1957 Norris
3,085,560 A * 4/1963 Peters ..... F41B 5/0094 124/23.1
3,227,454 A 1/1966 Ellenburg
3,614,947 A 10/1971 Feldman
4,624,068 A * 11/1986 Howard, III ..... A01K 81/00 43/6
4,839,979 A * 6/1989 Rogers ..... A01K 81/04 294/61
4,895,128 A 1/1990 Okada
5,311,855 A * 5/1994 Basik ..... F42B 6/04 124/24.1
5,335,439 A 8/1994 Horton
6,517,453 B2 * 2/2003 LaSee ..... F42B 6/04 124/86
6,550,178 B1 * 4/2003 Rogers ..... A01K 81/04 43/6
6,561,174 B1 * 5/2003 Afshari ..... F41B 5/143 124/44.5
6,634,350 B2 10/2003 LaSee
6,688,296 B1 * 2/2004 Greywall ..... F41B 5/143 124/44.5
6,688,297 B1 * 2/2004 Clague ..... F41B 5/143 124/44.5
7,331,886 B2 2/2008 Morris et al.
9,395,145 B2 7/2016 Woods, Jr.
(Continued)

*Primary Examiner* — Gene Kim
*Assistant Examiner* — Christopher Glenn
(74) *Attorney, Agent, or Firm* — Alvin R. Wirthlin

(57) ABSTRACT

An arrow rest assembly for bowfishing or the like includes a first arrow rest portion for supporting an arrow and a second arrow rest portion releasably connected to the first arrow rest portion, the second arrow rest portion has a bore for slidably receiving the shaft of an arrow. The second arrow rest portion slides along the arrow shaft and separates from the first arrow rest portion in a forward direction during forward movement of the arrow. A line extends between the archery bow and the second arrow rest portion for enabling retrieval of the arrow after it has been shot.

15 Claims, 11 Drawing Sheets

(56) References Cited

U.S. PATENT DOCUMENTS

| | | | | |
|---|---|---|---|---|
| 2003/0045381 | A1* | 3/2003 | Morris | F42B 6/06 473/578 |
| 2005/0076895 | A1* | 4/2005 | Walk | F41B 5/143 124/44.5 |
| 2010/0006079 | A1* | 1/2010 | Harwath | F41B 5/143 124/44.5 |
| 2010/0018513 | A1* | 1/2010 | Scaniffe | F41G 1/44 124/87 |
| 2010/0229845 | A1* | 9/2010 | Woods, Jr. | F41B 5/14 124/88 |

* cited by examiner

ARCHERY ARROW REST ASSEMBLY AND SLIDER THEREFOR

CROSS-REFERENCE TO RELATED APPLICATIONS

This application claims the benefit of U.S. Provisional Application No. 61/846,333 filed on Jul. 15, 2013, the disclosure of which is hereby incorporated by reference.

BACKGROUND OF THE INVENTION

This invention relates generally to accessories for archery, and more particularly to an arrow rest connectable to an archery bow and an arrow slider connectable to an arrow and engageable with the arrow rest for supporting the arrow during aiming and shooting. This invention also relates to an arrow slider that can be used independently of the arrow rest for bringing in prey via a line that is attached to the slider. The instant invention is especially ideal for bowfishing, hunting, or other activities where retrieval of an arrow and anything attached thereto is desired.

Bowfishing is quickly becoming a popular sport. Bowfishing typically includes the use of a projectile launching device, such as an archery bow, crossbow, specialty slingshot, as well as other devices, together with a fishing reel connected to mounting structure associated with the projectile launching device. A fishing line is typically attached at one end to the bow while the other end is slidably attached to an arrow with the fishing reel mounted between the ends of the fishing line. When an arrow is shot through a fish or other target, a special barb associated with the arrow tip grabs the fish, allowing the shooter to reel in the arrow with the fish. This sport allows an archer to maintain his or her skills offseason, and it helps the lakes by controlling the population of invasive/non-native species.

A major safety issue with bow fishing or other like sports is the possibility of entangling the line on the bow or bow accessories when the arrow is shot. If this happens, the arrow can suddenly and without warning reverse its direction a high rate of speed, potentially hitting the user or other bystanders and causing serious injury. Accordingly, it is important to keep the line clear of items on the bow that could potentially impede its movement.

As shown in FIG. 1, one accessory intended to minimize possible entanglement of the line is known as a slider 1. The slider 1 rides along the shaft 2 of an arrow 3 during shooting. A free end 4 of the fishing line 5 is connected to the slider. As the arrow clears the bow 6, the resistance from the line 5 as well as the abrupt acceleration of the arrow causes the slider 1 to move rearwardly on the arrow shaft. This movement allows the arrow to travel a more direct path than if the line 5 was connected to the forward end of the arrow. A stop 9 on the arrow shaft ensures that the slider 1 will stay on the arrow as the line is pulled back in. An arrow rest 7 is connected to the riser 8 of the bow 6 and is intended to support the arrow shaft during aiming and shooting. The arrow rest provides an adjustable sliding surface for the arrow, above the archer's hand and to the left of the riser (for a right-handed archer). Although the slider 1 is primarily intended to stay in front of the bow riser during shooting, the prior art does not provide any mechanism or assurance that the slider will always be forward of the bow riser. As shown in FIG. 1, the slider 1 may be mistakenly placed in a position behind the bow riser during aiming and shooting. This can inadvertently happen during the excitement of bowfishing or other like activities when the prey is spotted and the archer may not be as careful with the placement of the slider. Accordingly, there remains the potential for a catastrophic event during shooting. Moreover, the arrow stop 9 can interfere with the arrow rest 7 when the arrow is shot, causing the arrow to deflect away from its intended travel direction.

It would therefore be desirous to provide an arrow rest and/or arrow slider that overcomes one or more disadvantages of the prior art.

SUMMARY OF THE INVENTION

In accordance with one aspect of the invention, an arrow rest assembly includes a first arrow rest portion for supporting an arrow and a second arrow rest portion releasably connected to the first arrow rest portion, the second arrow rest portion including a bore for slidably receiving the shaft of an arrow. The second arrow rest portion slides along the arrow shaft and separates from the first rest portion in a forward direction during forward movement of the arrow.

In accordance with a further aspect of the invention, a slider adapted for sliding along an arrow shaft for retrieving an arrow after it has been shot, includes an inner hub, a bore extending through the inner hub, the bore being sized to slidably receive the arrow shaft, an outer wall surrounding the inner hub, at least one spoke extending between the inner hub and outer wall; and at least one gap formed between the inner hub and the outer wall for receiving a retrieval line.

In accordance with yet another aspect of the invention, an archery assembly includes: an archery bow having a riser, a pair of limbs connected to opposite ends of the riser, and a bowstring extending between the limbs; an arrow assembly having: an arrow shaft, an arrow tip and barb located at a first end of the arrow shaft, a nock located at a second end thereof, and a stop fixedly connected to the arrow shaft forwardly of the nock; and an arrow rest having a bracket connected to the riser, a first arrow rest portion having a body with a receptacle and a windage arm extending from the body adjustably connected to the bracket, a second arrow rest portion releasably received in the receptacle and including a central bore for slidably receiving the arrow shaft, and a line connected between the archery bow and the second arrow rest portion. With this arrangement, the arrow shaft slides through the second arrow rest portion upon release of the arrow during shooting until the stop contacts the second arrow rest portion and releases the second arrow rest portion from the first arrow rest portion, whereupon the second arrow rest portion travels with the arrow to thereby enable retrieval of the arrow by pulling back on the line.

It is noted that the drawings are intended to depict only typical embodiments of the invention and therefore should not be considered as limiting the scope thereof. It is further noted that the drawings may not be necessarily to scale. The invention will now be described in greater detail with reference to the accompanying drawings.

DETAILED DESCRIPTION OF THE INVENTION

Figure 3:
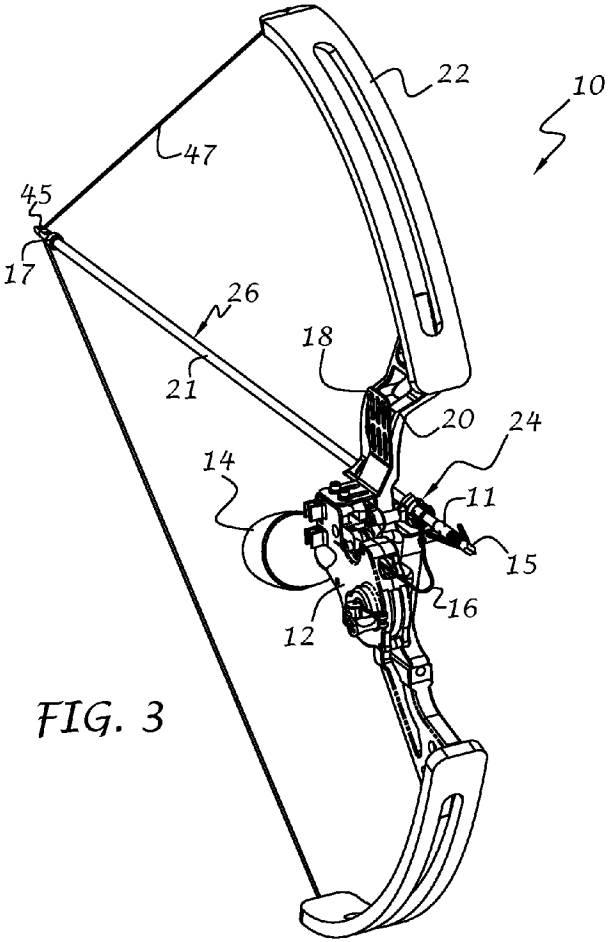
FIG. 3 is a front isometric view thereof.
Figure 2:
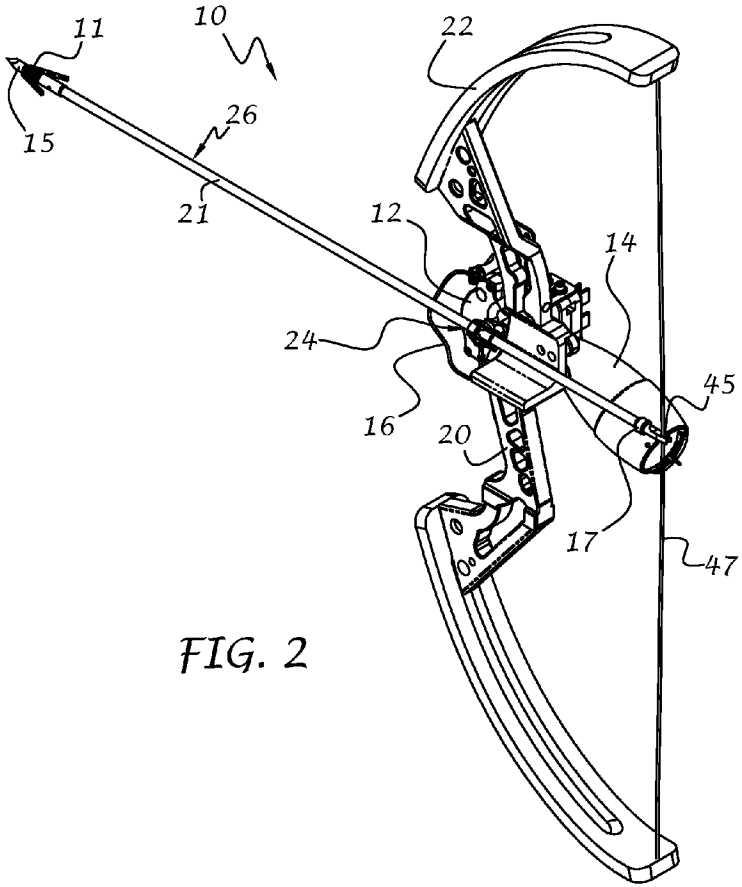
FIG. 2 is a rear isometric view of a bowfishing assembly in accordance with the invention.

Referring now to the drawings, and to FIGS. 2-3 in particular, a bowfishing assembly 10 in accordance with the invention is illustrated. The bowfishing assembly 10 includes a reel 12 connected to a removable compartment 14 for receiving and storing a fishing or retrieval line 16, and a bracket 18 for connecting the reel 12 to the riser 20 of an archery bow 22. An arrow rest assembly 24 is also connected to the riser 20 for supporting an arrow 26 during drawback of the bow and aiming. The archery bow 22 can include, but is not limited to, compound bows, recurve bows, longbows, flat bows, and so on, as well as specialty slingshots, pressure-powered devices, and other mechanisms. The line 16 feeds through the reel 12 with one end connected to the container 14 or other structure and the opposite end slidably connected to the arrow 26 or the like, as will be described in greater detail below. The reel 12 allows the user to retrieve the arrow 26, as well as captured fish or other prey (not shown). Further details of a suitable reel 12 can be found in copending U.S. application No. 61/844,673 filed on Jul. 10, 2013, the disclosure of which is hereby incorporated by reference. Further details of a suitable arrow 26 can be found in copending U.S. Application No. 61/840,920 filed on Jun. 28, 2013, the disclosure of which is hereby incorporated by reference. It will be understood that the arrow rest assembly 24 can be used with other reels and arrows, or can be used without a reel, without departing from the spirit and scope of the invention.

Figure 4:
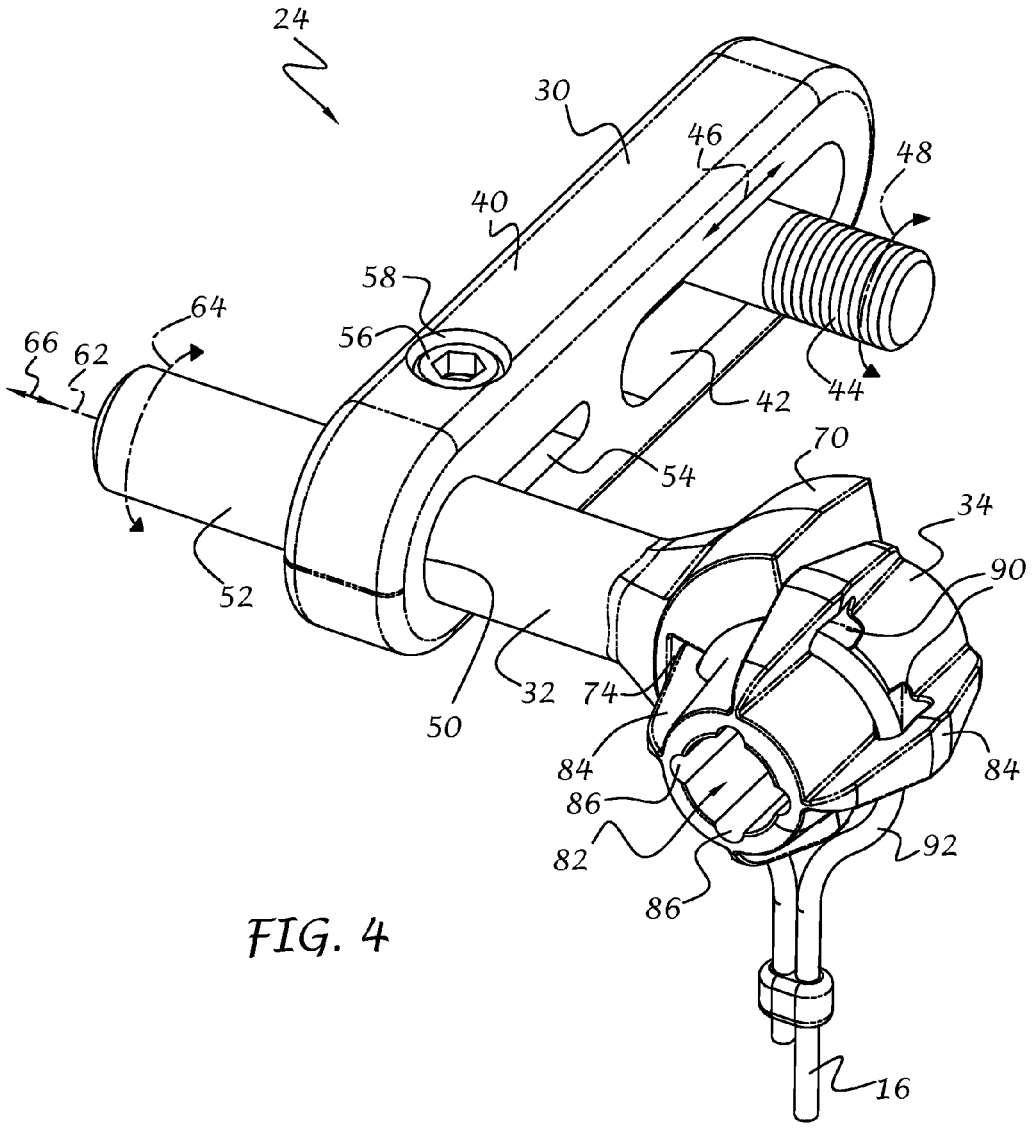
FIG. 4 is an enlarged left front isometric view of the arrow rest assembly with an attached arrow slider in accordance with the invention.
Figure 5:
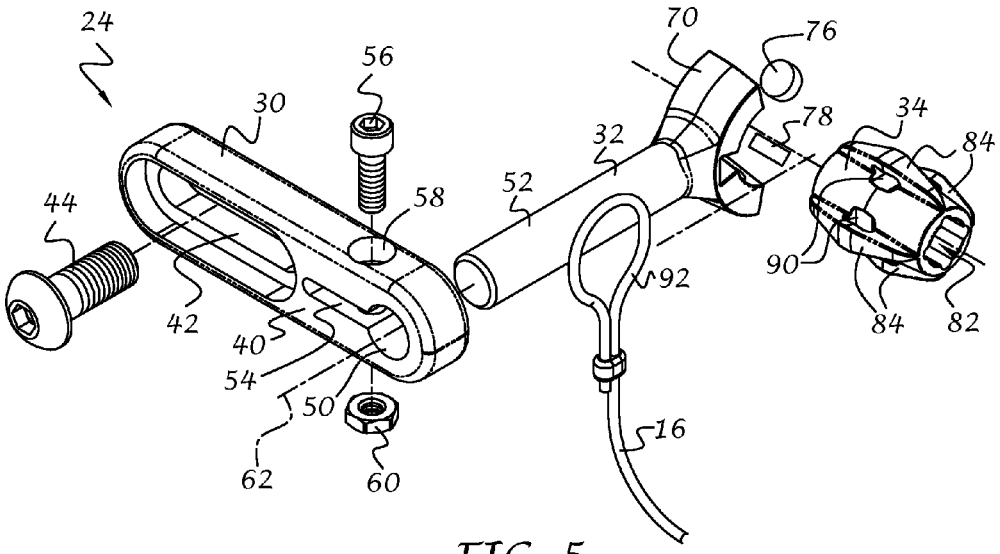
FIG. 5 is a right front isometric exploded view thereof.
Figure 6:
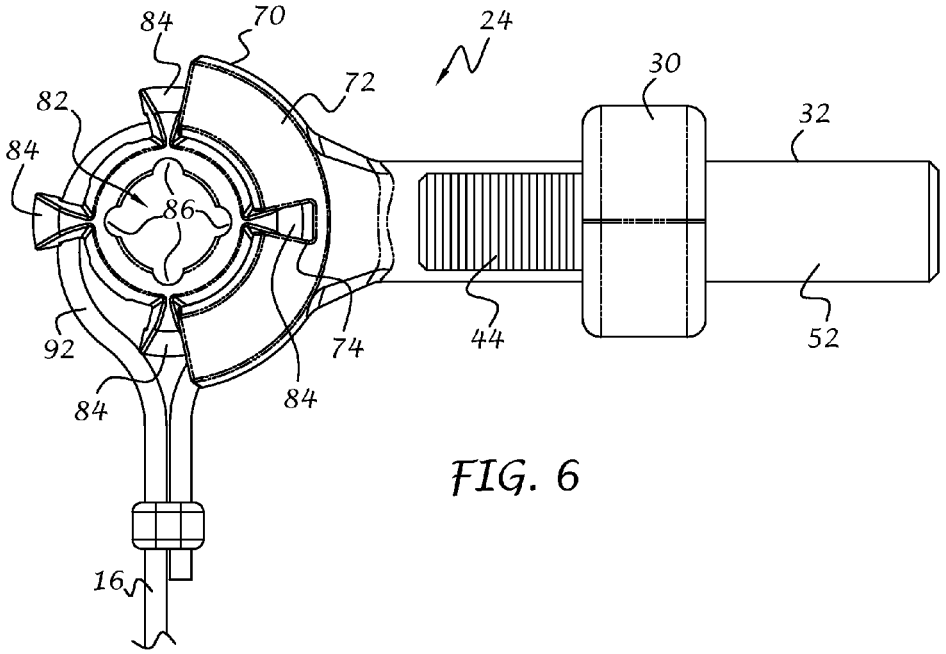
FIG. 6 is a rear elevational view thereof.
Figure 7:
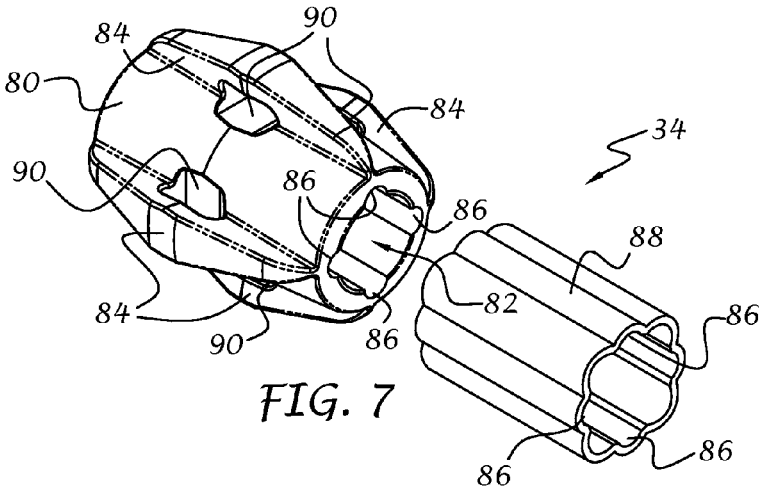
FIG. 7 is an isometric exploded view of an arrow slider in accordance with the invention that can form part of the arrow rest assembly.
Figure 8:
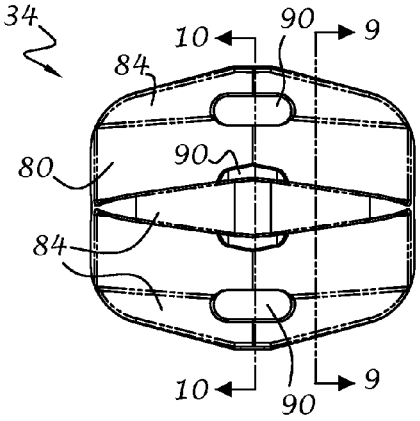
FIG. 8 is a top plan view thereof.
Figure 9:
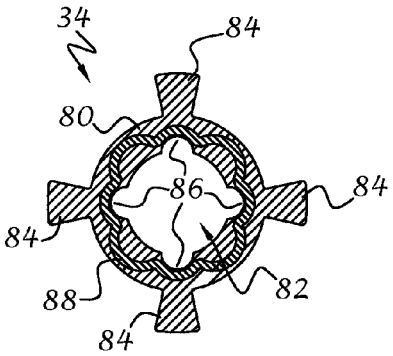
FIG. 9 is a sectional view thereof taken along line 9-9 of FIG. 8.
Figure 10:
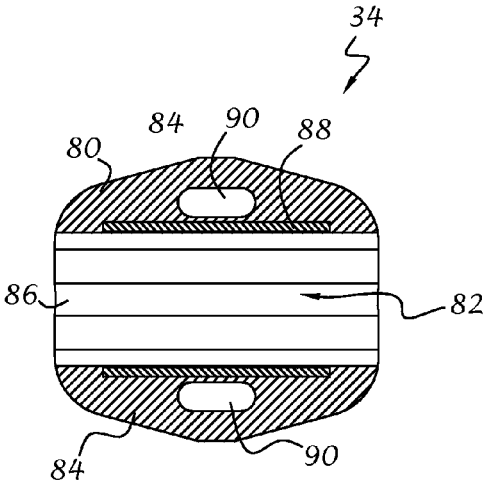
FIG. 10 is a sectional view thereof taken along line 10-10 of FIG. 8.

Referring now to FIGS. 4-6, the arrow rest assembly 24 preferably includes a mounting bracket 30 for connection to the riser 20 (FIGS. 2 and 3) of the bow 22 or the like, a first rest portion 32 adjustably connected to the mounting bracket 30, and a second rest portion 34 for connecting to the fishing line 16 and configured to be captured by the first rest portion 32. The second rest portion 34 is also configured as an arrow slider for traveling along a length of the arrow during bow drawback and shooting. The arrow slider 34 receives a fishing or retrieval line 16 so that the prey or intended target can be retrieved by pulling on the line and/or reeling the line back in.

The mounting bracket 30 preferably includes an elongate body 40 with an elongate slot 42 extending therethrough for receiving a fastener 44, such as the industry standard 5/16"-24 mounting screw for securing the mounting bracket 30 to a standard threaded opening in the riser 20. It will be understood that other fasteners or connection means can be used without departing from the spirit and scope of the invention. As shown in FIG. 3, the mounting bracket 30 is mounted on the same side of the riser 20 as the reel 12. However, it will be understood that the mounting bracket can be attached at any convenient location on the riser or other portion of the bow. The elongate slot 42 allows fore and aft adjustment of the bracket with respect to the bow riser, as represented by double direction arrow 46 (FIG. 4). Pivotally unconstrained, the bracket 30 can also rotate in clockwise and counterclockwise directions, as represented by double direction arrow 48 (FIG. 4) with respect to the fastener, and thus with respect to the riser 20. In this manner, the fore and aft position as well as the vertical position of the first rest portion 32 and second rest portion 34 can be adjusted, to thereby adjust the position of the arrow with respect to a nock position 45 on the bowstring 47 (FIGS. 2 and 3).

The mounting bracket 30 also includes a hole 50 that receives a windage rod 52 of the first rest portion 32. A slot 54 extends through the bracket 30 rearwardly from the hole 50 to allow expansion and retraction of the hole. A threaded fastener 56 extends through an opening 58 formed in the bracket 30 that extends perpendicular with respect to the slot 54 and intersects the slot. A nut 60 is positioned on the underside of the bracket 30 for engaging the fastener 56. The fastener 56 can be loosened to expand the slot 54 and thus the hole 50, and can be tightened to reduce the height of the slot 54 and thus the diameter of the hole 50. The windage rod 52 of the first rest portion 32 is thus frictionally clamped via the hole 50. The circular shape of the hole 50 also allows rotation of the first rest portion 32 and second rest portion 34 about an axis 62 in clockwise and counterclockwise directions, as represented by double direction arrow 64 in FIG. 4, so that the angle of the first and second rest portions can be adjusted with respect to the arrow once the vertical position of the second rest portion 34 is set. In addition, the windage rod 52 of the first rest portion 32 can move in a lateral direction, as denoted by double direction arrow 66 in FIG. 4, to thereby adjust a lateral position or "windage" of the arrow with respect to the nock position 45 (FIGS. 2 and 3).

The first rest portion 32 also includes a collar 70 located at an outer free end of the windage rod 52. The collar 70 is configured to removably receive and capture the second rest portion 34, and thus the arrow 26, when connected thereto. The collar 70 preferably includes an arcuate-shaped body 72 with a dovetail-shaped groove or receptacle 74 formed therein. Magnets 76, 78 (FIG. 5) are positioned in the body 72 on either side of the groove 74. Although the collar 70 is shown as arcuate or semi-cylindrical, it will be understood that the collar can be cylindrical in shape or of any other suitable shape without departing from the spirit and scope of the invention. It will be further understood that the collar can be open (as shown) or closed and yet remain within the purview of the invention.

Figure 1:
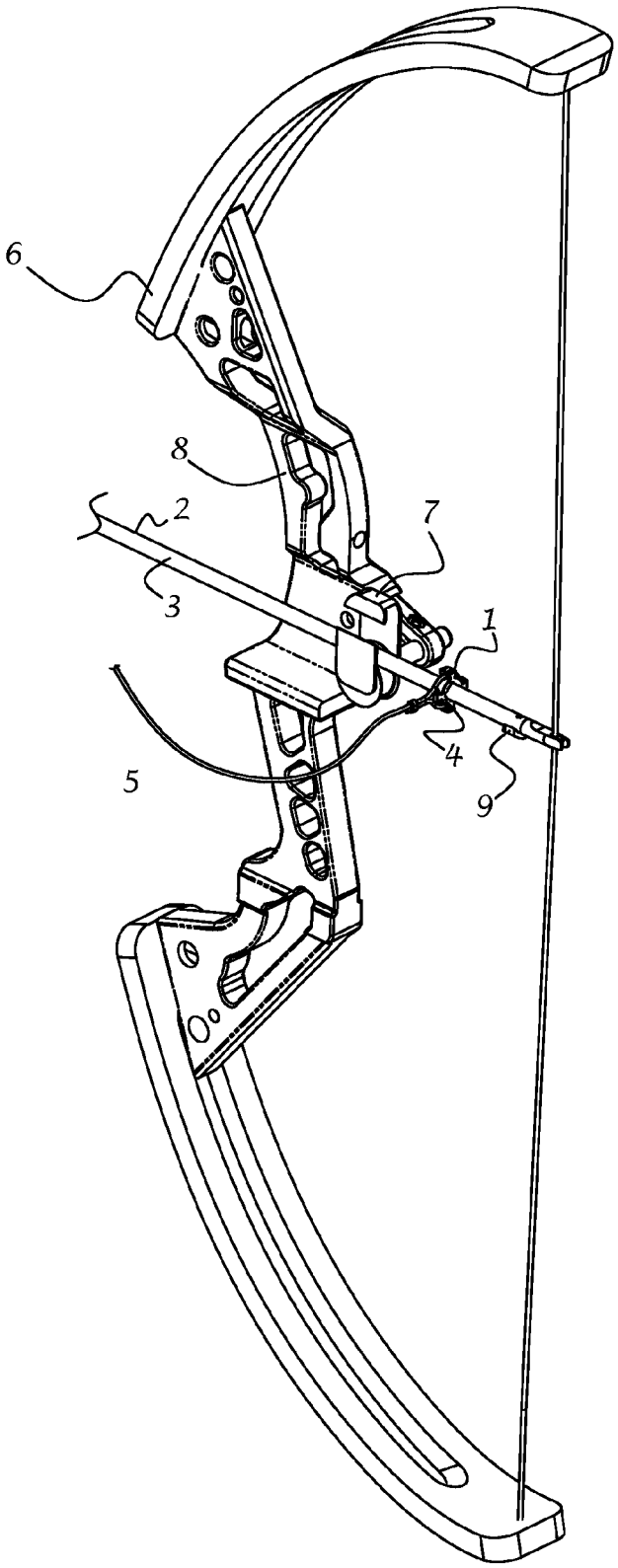
FIG. 1 (Prior Art)
FIG. 1 is an isometric rear view of a prior art bowfishing setup.

With particular reference to FIGS. 7-10, the second rest portion 34 is preferably in the form of a slider that is adapted to slide along a length of the arrow 26 (FIG. 2) during bow drawback and shooting. The slider 34 preferably includes a generally cylindrically-shaped body 80 with a bore 82 extending axially therethrough and a plurality of dovetail-shaped projections 84 extending radially therefrom. The bore 82 is sized to fit around an arrow shaft 21 (FIG. 2) so that the arrow shaft 21 slides therethrough with minimal resistance but is small enough to be captivated by the fishing barb 11 associated with the arrow tip 15 (FIGS. 2 and 3) at the tip end of the arrow shaft 21 and/or annular arrow stop 17 or arrow stop 9 (FIG. 1) near the nock end of arrow shaft 21. Preferably, the second rest portion 34 remains connected to the arrow 26 at all times during use. In order to remove the second rest portion 34, either the arrow tip with its accompanying barb or the annular arrow stop 17 must first be removed. The projections 84 are sized to be received within the dovetail-shaped groove 74.

Figure 15:
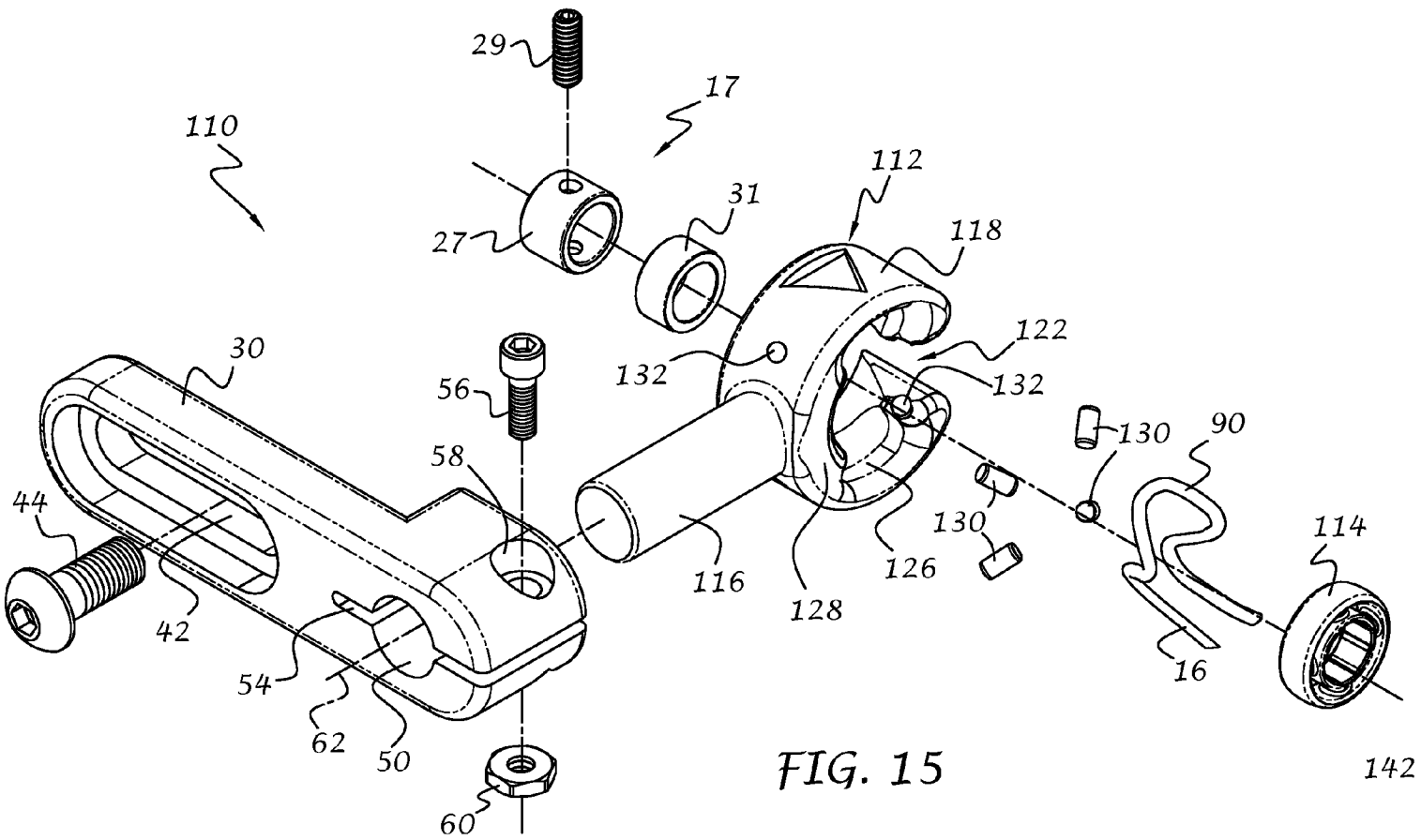
FIG. 15 is a front right isometric exploded view of the arrow rest assembly of FIG. 11.
Figure 16:
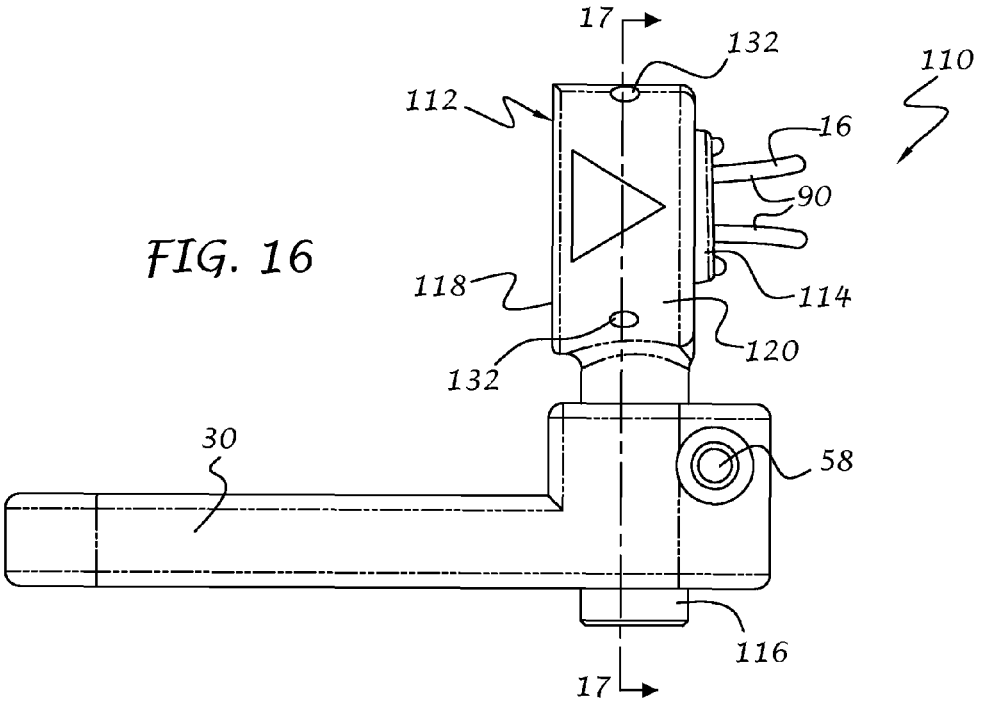
FIG. 16 is a top plan view of the arrow rest assembly of FIG. 11 showing the line extending forward in a properly connected position.
Figure 17:
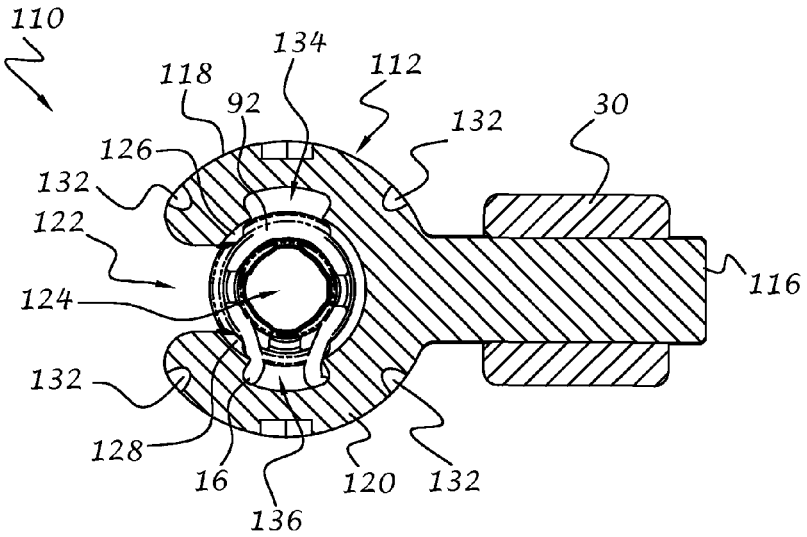
FIG. 17 is a sectional view thereof taken along line 17-17 of FIG. 16.

An insert 88 is preferably co-molded with the body 80 and is coincident with the bore 82 for slidably receiving an arrow 26 (FIG. 2) or the like. A series of axially extending slots 86 are formed in the bore 82 so that foreign particles, such as sand or dirt, that may collect during bowfishing, can easily be expelled. The insert is preferably constructed of a ferrous metal so that the second rest portion 34 is connected to the first rest portion 32 via magnetic attraction between the magnets 76, 78 (FIG. 5) and the insert 88. In this manner, the second rest portion 34, and thus the arrow 26, are firmly held by the first rest portion 32 during carrying and aiming. In order to release the second rest portion 34 from the first rest portion 32, the arrow 26 can be shot, thereby causing the arrow stop 17 (FIG. 2), which includes a sleeve 27 fastened to the arrow shaft 21 of the arrow 26 via a fastener 29, and an elastomeric bumper 31 (FIG. 15), to contact the second rest portion and overcome frictional and magnetic forces between the first and second rest portions. The second rest portion 34 can also be released simply by pushing it forward since the frictional and magnetic forces holding the second rest portion in place are minimal. Preferably, the opposite ends of the dovetail-shaped projections 84 and the dovetail-shaped groove 74 are tapered to aid in easy connection of the two rest portions as well as providing a positive stop against rearward movement and maintaining repeatable positioning of the second rest portion with respect to the first rest portion. Apertures 90 can be formed in the projections 84 for receiving a loop portion 92 of a fishing or retrieval line 16 or the like, so that any captured prey or other object, or just the arrow itself, can be reeled or pulled in by the archer.

Figure 11:
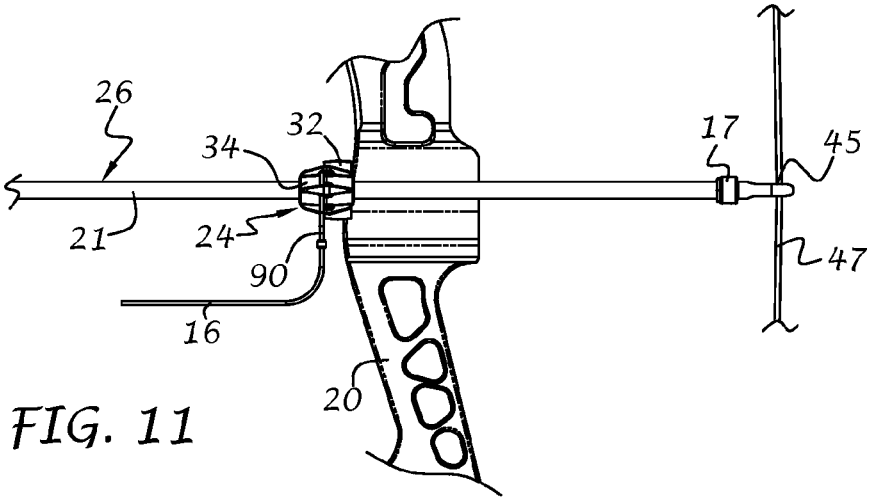
FIG. 11 is a left side elevational view of an arrow rest assembly in accordance with the invention connected to a bow and arrow and showing the arrow slider properly captured by the arrow rest assembly.
Figure 12:
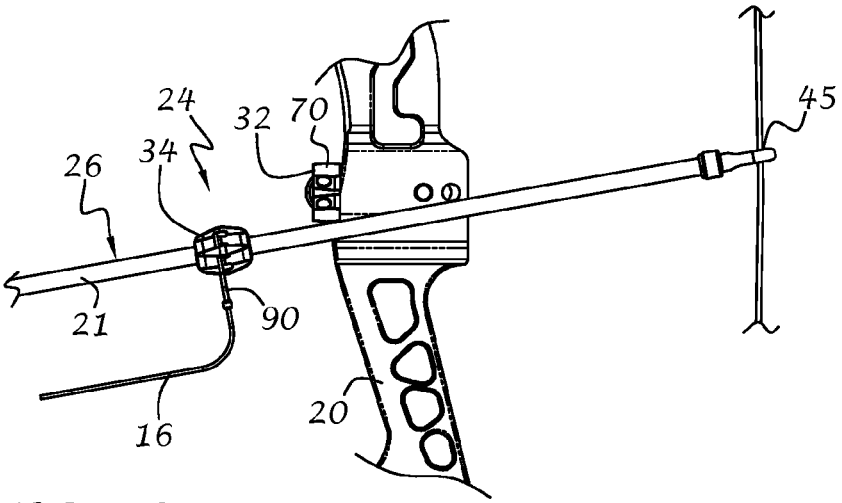
FIG. 12 is a view similar to FIG. 11 illustrating the position of the arrow when not properly captured by the arrow rest assembly.

With additional reference to FIGS. 11 and 12, in use, when the arrow 26 is first loaded onto the archery bow, the user can tell immediately if the second rest portion or slider 34 is properly captured within the first rest portion 32, thus avoiding prior art problems of inadvertently shooting an arrow when a slider is located behind the riser 20. As shown in FIG. 11, the second rest portion or slider is properly captured within the first rest portion 32. As shown in FIG. 12, the second rest portion or slider is not properly captured, which causes the arrow to fall or rest against the riser shelf, due to the open nature of the first rest portion 32. In this position, the archer will note immediately that the arrow is not positioned correctly. The second rest portion can then be grasped by a user and slid along the arrow shaft 21 until it is captured within the first rest portion.

When an arrow is shot in the proper position, the arrow stop 9, 17 will only contact the second rest portion, not the first rest portion, thereby eliminating the possibility of arrow deflection as is common in the prior art when the arrow is improperly nocked or when the arrow stop hits a portion of the arrow rest and causes deflection of the arrow 26. With the present invention, it does not matter how the arrow is nocked, since the first rest portion provides sufficient clearance for the stop and any accessories that may be attached to the arrow 26.

Turning now to FIGS. 13 to 17, an arrow rest assembly 110 in accordance with a further embodiment of the invention is illustrated. The arrow rest assembly 110 preferably includes a mounting bracket, such as mounting bracket 30 previously described, for connection to the riser 20 (FIGS. 2 and 3) of the bow 22 or the like. Since the mounting bracket 30 is identical to the mounting bracket previously described, it will not be further elaborated on, it being understood however that like numerals represent like parts. It will be further understood that the present invention can be used with any suitable mounting bracket without departing from the spirit and scope of the invention.

The arrow rest assembly 110 also includes a first rest portion 112 adjustably connected to the mounting bracket 30 and a second rest portion 114 configured to be captured by the first rest portion 112. As in the previous embodiment, the second rest portion 114 is also configured as an arrow slider for traveling along a length of the arrow shaft 21 during bow drawback and shooting. The arrow slider 114 receives a fishing or retrieval line 16 or the like so that the prey or intended target can be retrieved by pulling on the line and/or reeling the line back in.

A windage rod 116 of the first rest portion 112 is received within the hole 50 of the mounting bracket 30. The threaded fastener 56 extends through the opening 58 formed in the bracket 30 and the nut 60 is positioned on the underside of the bracket 30 for engaging the fastener 56, such that the slot 54 and thus the hole 50, can be expanded and contracted to alternatively loosen and tighten the grip between the mounting bracket 30 and the windage rod 116 of the first rest portion 112. The windage rod 116 of the first rest portion 112 is thus frictionally clamped via the hole 50. The circular shape of the hole 50 also allows rotation of the first rest portion 112 and second rest portion 114 (when connected) about the axis 62 in clockwise and counterclockwise directions, as previously described, so that the angle of the first and second rest portions can be adjusted with respect to the arrow shaft 21 once the vertical position of the second rest portion 114 is set. In addition, the windage rod 116 can move in a lateral direction to thereby adjust a lateral position or "windage" of the arrow 26 with respect to the nock position 45 (FIGS. 2 and 3).

The first rest portion 112 also includes a collar 118 located at an outer free end of the windage rod 116. The collar 118 is configured to removably receive and capture the second rest portion 114, and thus the arrow shaft 21 when connected thereto. The collar 118 preferably includes a generally cylindrically-shaped body 120 with an axial gap or space 122 formed therein to reduce the weight of the collar 118 and to allow side loading of the arrow assembly 26. It will be understood that the space 122 can be eliminated without departing from the spirit and scope of the invention. A central bore 124 extends axially through the body 120 and intersects with the gap 122. The bore 124 is adapted to receive the second rest portion or slider 114 and hold the slider in place during drawback and aiming. To that end, a depression or receptacle 126 is formed in the front face 128 of the body 120 to receive the second rest portion 114.

Magnets 130 (FIG. 15) are located in angled apertures 132 to retain the second rest portion 114 in the collar 118. The second rest portion 114 may be made of a material that is attracted to the magnets or may be constructed of a plastic or ceramic material with magnetic inserts or a metallic insert (as described above with respect to the first embodiment) that is attracted by one or more magnets or by the application of a magnetic coating on the outer surface so that the second rest portion 114 is normally held in the first rest portion 112. However, it will be understood that the second rest portion can be removably connected to the first rest portion through any known releasable connection means such as friction, sticky surfaces, hook and loop fasteners or other interconnecting structure, spring-loaded contacts, and so on. An upper gap 134 and lower gap 136 (FIG. 17) are formed in the body 120 and intersect the bore 124. The gaps 134, 136 provide clearance for the fishing line 16 or the like since it wraps around the second rest portion 114 at either the upper end or lower end thereof when the second rest portion is docked in the first rest portion to ensure that the line is always forward of the riser of the bow during drawback, aiming, and shooting. It will be understood that one or more gaps can be formed in the sides of the first rest portion 112, such as the gap 122, so that the line can wrap around one or more of the sides of the second rest portion 114 while being free from potential obstructions in order to keep the line in front of the riser at all times.

Although the collar 118 is shown as arcuate or semi-cylindrical, it will be understood that the collar can be cylindrical in shape or of any other suitable shape without departing from the spirit and scope of the invention.

Figure 18:
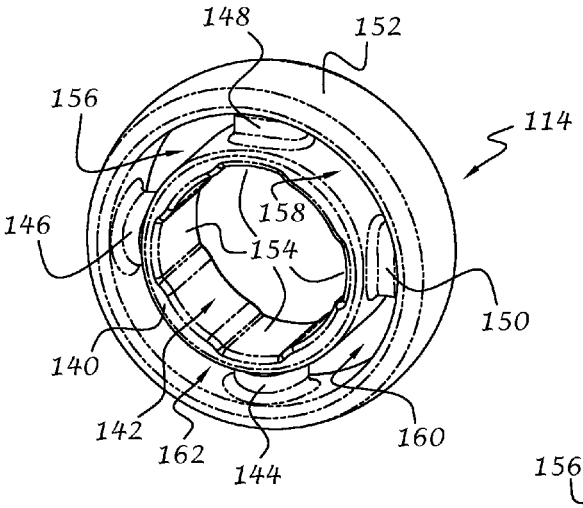
FIG. 18 is a rear isometric view of the arrow slider second embodiment.
Figure 19:
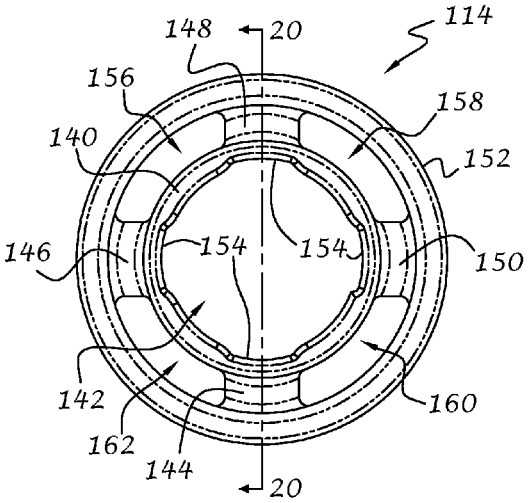
FIG. 19 is a front or rear elevational view thereof.
Figure 20:
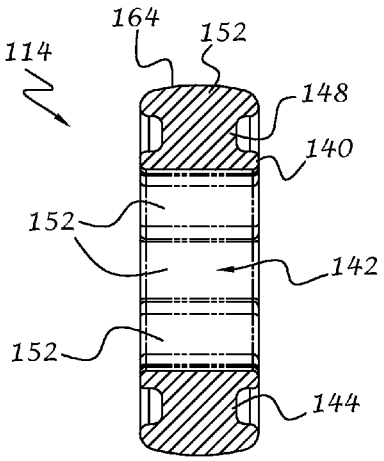
FIG. 20 is a sectional view thereof taken along line 20-20 of FIG. 19.

With particular reference to FIGS. 18-20, the second rest portion 114 is preferably in the form of a slider that is adapted to slide along a length of the arrow shaft 21 during bow drawback and shooting, while capturing the fishing or retrieval line 16 so that the captured prey or other object can be drawn back to the user. The slider 114 preferably includes a generally cylindrically-shaped inner hub 140 with a bore 142 extending axially therethrough and a plurality of spokes144, 146, 148, and 150 extending radially therefrom. An outer annular wall 152 is connected to an outer end of the spokes and is preferably coaxial with the inner hub.

The bore 142 is sized to fit around the shaft 21 of an arrow 26 (FIG. 13) so that the arrow shaft 21 slides therethrough with minimal resistance but is small enough to be captivated by the fishing barb 11 associated with the arrow tip 15 at the tip end of the arrow shaft 21 and/or annular arrow stop 17 or arrow stop 9 (FIG. 1) near the nock end of arrow shaft 21. In this manner, the second rest portion 114 remains slidably connected to the arrow shaft 21 at all times during use. When it is desirous to change the slider 114, the arrow stop and/or arrow tip with its accompanying barb can be removed to enable the slider to slide off the arrow shaft 21. A series of axially extending slots 154 can be formed in the bore 142 so that foreign particles, such as sand or dirt, that may collect during bowfishing, can easily be expelled.

The spokes 144, 146, 148, and 150 are generally cylindrical in shape as shown to minimize resistance to air and water while in use, but may be of any suitable shape, as long as they do not have sharp edges that could potentially cut the line 16. Although the height of the spokes can vary, they are preferably long enough to permit the line 16 to loop around one or more of the spokes and through the gaps 156, 158, 160, and 162 formed between the spokes. It will be understood that more or less radially extending spokes and their accompanying gaps can be provided. It will be further understood that the spokes need not extend in a radial direction but can be oriented at different angles without departing from the spirit and scope of the invention.

The outer wall 152, as best shown in FIG. 20, has a curved outer surface 164 that complements the shape of the depression or receptacle 126 in the first rest portion 112. However, it will be understood that the outer wall can be flat or of any suitable shape. The outer wall provides both structural integrity to the slider 114 and also helps to retain the line 16 on the slider 114. The outer wall need not be solid in order to retain the line, but may have one or more axially extending slots between the spokes to retain the line. In order to release the second rest portion 114 from the first rest portion 112, the arrow 26 can be shot, thereby causing the arrow stop 9 (FIG. 1) or arrow stop 17 (FIG. 15) to contact the second rest portion 114 and overcome the forces holding the two rest portions together. The second rest portion 114 can also be released simply by pushing it forward since the magnetic forces holding the second rest portion in place are minimal.

Figure 13:
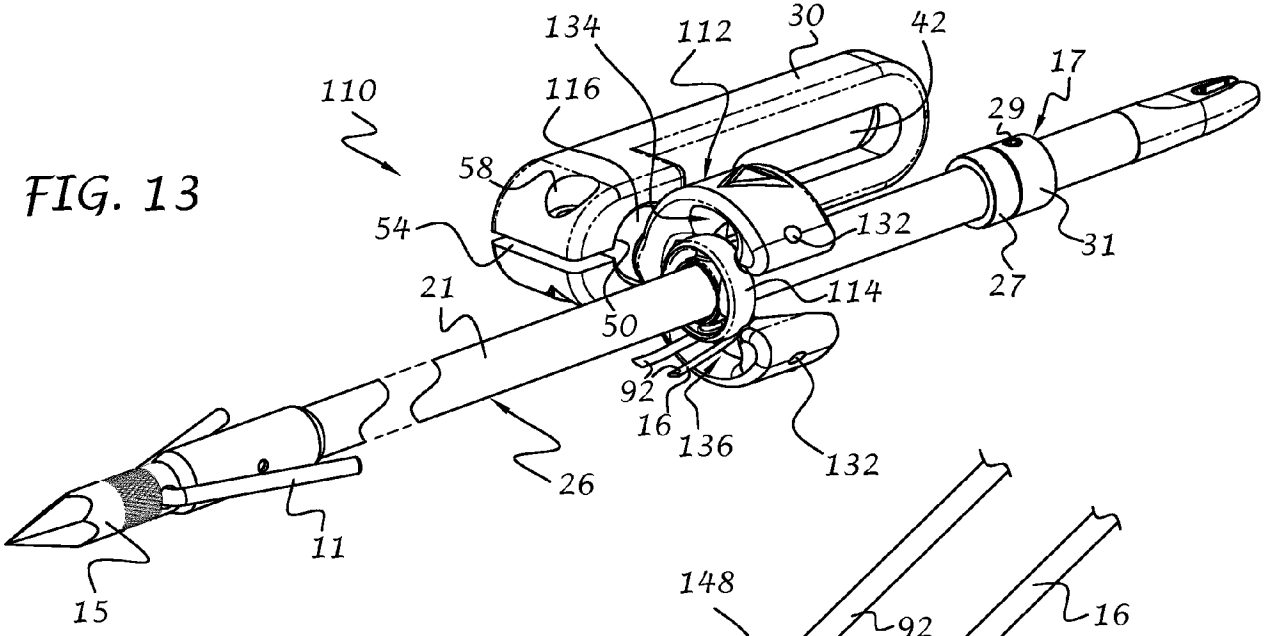
FIG. 13 is a front left isometric view of an arrow rest assembly and captured slider in accordance with a further embodiment of the invention.
Figure 14:
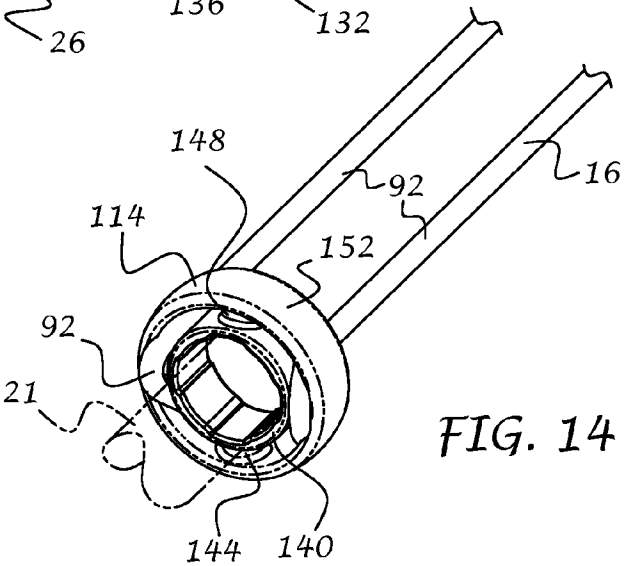
FIG. 14 is a front dimetric view of the arrow slider showing the attached line extending rearwardly when in flight.

In order to connect the fishing line 16 or the like to the second rest portion or slider 114, and by way of example, one end of the line is fed forwardly through the gap 156, looped around the spoke 146, fed rearwardly through the gap 162, looped around the spoke 144, fed forwardly through the gap 160, looped around the spoke 150, then fed rearwardly through the gap 158. The end of the fishing line can then be tied to itself or otherwise configured to form the loop portion 92 (FIG. 14). In this manner, the line 16 can slide through the gaps and around the spokes while being manually adjusted or during shooting so that the loop portion 92, and thus the line 16, self-centers during flight to thereby better control the flight path of the arrow. When the slider 114 is docked in the first rest portion 112, as shown in FIG. 13, the loop portion 92 of the line 16 can be wrapped around the bottom, top, or side of the outer wall so that it is facing forwardly. In this manner, all obstacles are removed so that the line cannot get caught on the bow or bow accessories. When the arrow is in flight, the slider 114 rests against the stop 17 and the line now extends behind the slider, as shown in FIG. 14.

When an arrow is shot in the proper position, the arrow stop 17 (or 9 in FIG. 1) will only contact the second rest portion, not the first rest portion, thereby eliminating the possibility of arrow deflection as is common in the prior art when the arrow is improperly nocked or when the arrow stop hits a portion of the arrow rest and causes deflection of the arrow. With the present invention, the first rest portion provides sufficient clearance for the stop and any accessories that may be attached to the arrow to thereby prevent unwanted deflection of the arrow during shooting.

Figure 21:
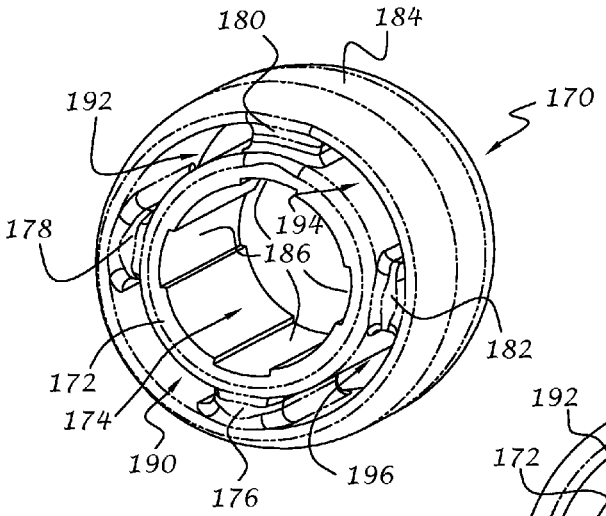
FIG. 21 is a rear isometric view of an arrow slider in accordance with another embodiment of the invention.
Figure 22:
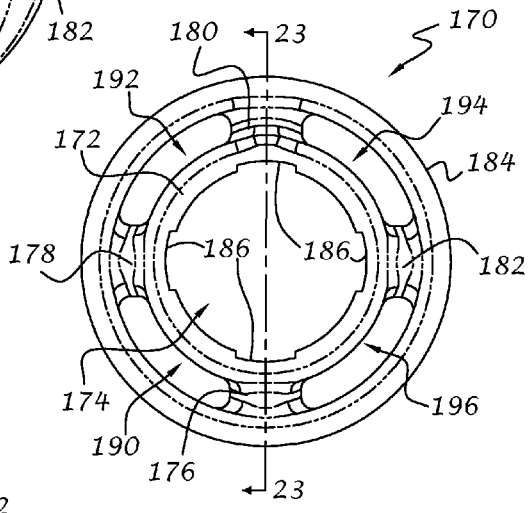
FIG. 22 is a front or rear elevational view thereof.
Figure 23:
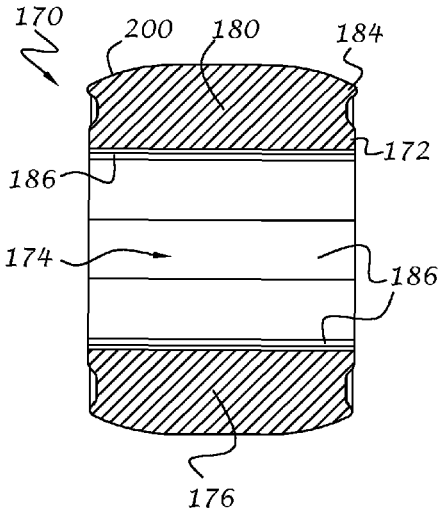
FIG. 23 is a sectional view thereof taken along line 23-23 of FIG. 22.

Turning now to FIGS. 21 to 23, a second rest portion or slider 170 in accordance with yet a further embodiment of the invention is illustrated. The slider 170 is similar in construction to the slider 114 previously described, with the exception that the slider 170 has been elongated to accommodate potentially higher forces associated with higher poundage bows and larger prey to be pulled in. The slider 170 is adapted to slide along a length of the arrow shaft 21 (FIG. 15) during bow drawback and shooting, while capturing the fishing line 16 so that the captured prey or other object can be drawn back to the user.

The slider 170 preferably includes a generally cylindrically-shaped inner hub 172 with a bore 174 extending axially therethrough, and a plurality of spokes 176, 178, 180, and 182 extending radially outwardly therefrom. An outer annular wall 184 is connected to an outer end of the spokes and is preferably coaxial with the inner hub.

The bore 174 is sized to fit around the shaft 21 of an arrow 26 (FIG. 15) so that the arrow shaft 21 slides therethrough with minimal resistance but is small enough to be captivated by the fishing barb 11 associated with the arrow tip 15 at the tip end of the arrow shaft 21, as well as the annular arrow stop 17 or arrow stop 9 (FIG. 1) near the nock end of arrow shaft 21. In this manner, the second rest portion 170 remains slidably connected to the arrow shaft 21 at all times during use. When it is desirous to change the slider 170, the arrow stop and/or arrow tip with its accompanying barb can be removed to enable the slider to slide off the arrow shaft 21. A series of axially extending slots 186 can be formed in the bore 174 so that foreign particles, such as sand or dirt, that may collect during bowfishing, can easily be expelled.

The spokes 176, 178, 180, and 182 are generally rectangular in shape as shown to minimize resistance to air and water while in use, but may be of any suitable shape, as long as they do not have sharp edges that could potentially cut the line 16. Although the height of the spokes can vary, they are preferably long enough to permit the line 16 to loop around one or more of the spokes and through the gaps 190, 192, 194, and 196 formed between the spokes. It will be understood that more or less radially extending spokes and their accompanying gaps can be provided. It will be further understood that the spokes need not extend in a radial direction but can be oriented at different angles without departing from the spirit and scope of the invention.

The outer wall 184, as best shown in FIG. 23, has an arcuate or curved outer surface 200 that complements the shape of the depression or receptacle 126 in the first rest portion 112. The outer wall 184 serves to hold the line on the slider 170 and also provides structural integrity for the slider 170. The outer wall need not be solid as shown, but can have slots extending axially therethrough between the spokes to thereby hold the line on the slider 170. The first rest portion 112 can also be modified to have a longer collar and depression to accommodate the length of the slider 170. However, it will be understood that the outer wall can be flat or of any suitable shape.

In order to release the second rest portion 170 from the first rest portion 112, the arrow 26 can be shot, thereby causing the arrow stop 9 (FIG. 1) or arrow stop 17 (FIG. 15) to contact the second rest portion 170 and overcome the forces holding the two rest portions together. The second rest portion 170 can also be released simply by pushing it forward since the magnetic forces holding the second rest portion in place are minimal.

Connection of the fishing line 16 to the slider 170 is similar to the procedure previously described with respect to the slider 114, and therefore will not be further described.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. It will be understood, therefore, that the present invention is not limited to the particular embodiments disclosed, but also covers modifications within the spirit and scope of the invention as defined by the appended claims.

What is claimed is:

1. An arrow rest assembly for connection to an archery bow and to the shaft of an arrow, the arrow rest assembly comprising:

a first arrow rest portion connectable to the archery bow, the first arrow rest portion having a body with a fixed receptacle formed therein and defining a longitudinal axis, the fixed receptacle including first releasable retaining structure;

a second arrow rest portion releasably captured in the fixed receptacle in a first captured condition and having:

1) a support for slidably supporting the arrow shaft such that the arrow shaft is spaced from the first arrow rest portion and extends along the longitudinal axis when the arrow shaft is supported by the second arrow rest portion; and 2) second releasable retaining structure cooperative with the first releasable retaining structure of the first arrow rest portion to:

a) retain the second arrow rest portion against lateral movement with respect to the longitudinal axis of the fixed receptacle in the first captured condition to thereby prevent unintended lateral disconnection of the second arrow rest portion, and thus the arrow shaft, with respect to the first arrow rest portion at least during drawback, aiming and shooting; and b) permit movement of the second arrow rest portion along the longitudinal axis to a second released condition wherein the second arrow rest portion is completely separated from the first arrow rest portion;

wherein the second arrow rest portion:

1) is slidably mountable on the arrow shaft;

2) slides along the arrow shaft from a forward shaft position to a rearward shaft position at least upon firing the arrow from the archery bow in the first captured condition; and 3) completely separates from the first arrow rest portion in a forward direction along the longitudinal axis during forward movement of the arrow at least during shooting to thereby move the second arrow rest portion from the first captured condition to the second released condition while retaining the second arrow rest portion on the arrow shaft.

2. An arrow rest assembly according to claim 1, and further comprising:

the support comprising a bore extending through the second arrow rest portion for slidably receiving the arrow shaft, a central axis of the bore being coincident with the longitudinal axis when in the first captured condition;

a stop for connection to a nock end of the arrow shaft, the stop engaging the second arrow rest portion without engaging the first arrow rest portion to thereby completely separate the second arrow rest portion from the first arrow rest portion when the stop engages the second arrow rest portion at least during shooting such that the second arrow rest portion is completely released from the first arrow rest portion along the longitudinal axis and is supported in flight by the arrow.

3. An arrow rest assembly according to claim 1, wherein the first releasable retaining structure of the first arrow rest portion comprises at least one magnet mounted in the body near the fixed receptacle, and the second releasable retaining structure of the second arrow rest portion comprises a magnetically attractive or repulsive feature for magnetically holding the second arrow rest portion in the fixed receptacle.

4. An arrow rest assembly according to claim 1, and further comprising:

a bracket for connection to the archery bow; and a windage rod extending from the body and retained by the bracket for connecting the arrow rest assembly to the archery bow.

5. An arrow rest assembly according to claim 1, wherein:

the first retaining structure of the fixed receptacle comprises a dovetail-shaped groove; and the second retaining structure of the second arrow rest portion comprises a dovetail-shaped projection for engaging the dovetail-shaped groove of the fixed receptacle to thereby hold the second arrow rest portion in the fixed receptacle against lateral movement with respect to the longitudinal axis while in the first captured condition.

6. An arrow rest assembly according to claim 1, wherein:

the first retaining structure of the fixed receptacle comprises a generally circular depression located in the body for receiving the second arrow rest portion; and the second arrow rest portion being generally circular in shape such that the circular depression of the first retaining structure extends at least partially around the second arrow rest portion when the first and second arrow rest portions are connected together in the first captured condition.

7. An arrow rest assembly according to claim 6, wherein the second arrow rest portion further comprises:

an inner hub with a bore extending therethrough; and an outer generally circular wall surrounding the inner hub, the outer generally circular wall being received within the generally circular depression of the first retaining structure when the first and second arrow rest portions are connected together in the first captured condition; and a plurality of spokes extending outwardly from the inner hub toward the outer circular wall.

8. An arrow rest assembly according to claim 7, and further comprising:

a retrieval line having a first end with a series of loops connected to the second arrow rest portion such that the second arrow rest portion can be drawn back to the first captured condition from the second released condition;

the second arrow rest portion having first, second, third and fourth gaps formed between adjacent first, second, third, and fourth spokes, respectively; and wherein the series of loops comprises:

a first end portion of the first end of the retrieval line extending forwardly through the first gap and around the first spoke to thereby form a first loop oriented forwardly;

a second end portion of the retrieval line extending rearwardly through the second gap and around the second spoke to thereby form a second loop oriented rearwardly;

a third end portion of the retrieval line extending forwardly through the third gap and around the third spoke to thereby form a third loop oriented forwardly;

a fourth end portion of the retrieval line extending rearwardly through the fourth gap such that the first end portion and fourth end portion are separated by the fourth spoke;

wherein the fourth end portion is connected to the retrieval line at a position spaced from the first end portion to thereby secure the retrieval line to the second arrow rest portion.

9. An arrow rest assembly according to claim 7, wherein the plurality of spokes are generally cylindrical in shape and each spoke extends radially between the inner hub and the outer wall.

10. An arrow rest assembly according to claim 7, wherein the plurality of spokes are generally rectangular in shape and each spoke extends radially between the inner hub and the outer wall.

11. An arrow rest assembly according to claim 1, and further comprising:

the first retaining structure of the first receptacle having a generally circular depression located in the body for receiving the second arrow rest portion;

the second arrow rest portion having an inner generally circular hub with a bore extending through the inner hub, an outer generally circular wall surrounding the inner hub, a plurality of spokes extending radially between the inner hub and outer wall, with the outer generally circular wall being at least partially surrounded by the generally circular depression to thereby releasably retain the second arrow rest portion within the first arrow rest portion; and a stop for connection to a nock end of the arrow shaft, the stop engaging the inner hub of the second arrow rest portion without engaging the first arrow rest portion only upon sliding movement of the arrow along the longitudinal axis through the bore, with the second arrow rest portion remaining stationary in the circular depression in the first captured condition during forward sliding movement of the arrow shaft until the stop engages the inner hub to thereby release and completely separate the second arrow rest portion from the first arrow rest portion along the longitudinal axis to thereby move the second arrow rest portion from the first captured condition to the second released condition.

12. An archery assembly comprising:

an archery bow comprising:

a riser;

a pair of limbs connected to oppposite ends of the riser; and a bowstring extending between the limbs;

an arrow asembly comprising:

an arrow shaft;

an arrow tip located at a first end of the arrow shaft;

a nock located at a second end thereof; and a stop fixedly connected to the arrow shaft forwardly of the nock; and an arrow rest comprising:

a bracket connected to the riser;

a first arrow rest portion having:

a body;

a receptacle formed in the body and defining a longitudinal axis;

first retaining structure connected to the body and associated with the receptacle; and a windage arm extending from the body; the windage arm being adjustably connected to the bracket;

a second arrow rest portion releasably received in the receptacle of the first arrow rest portion in a first captured condition and having:

1) a support for slidably supporting the arrow shaft such that the arrow shaft is spaced from the first arrow rest portion and extends along the longitudinal axis when the arrow shaft is supported by the second arrow rest portion; and 2) second releasable retaining structure cooperative with the first retaining structure of the first arrow rest portion to:

a) retain the second arrow rest portion against lateral movement with respect to a the longitudinal axis of the receptacle in the first captured condition to thereby prevent unintended lateral disconnection of the second arrow rest portion, and thus the arrow shaft, with respect to the first arrow rest portion at least during drawback, aiming and shooting; and b) permit movement of the second arrow rest portion along the longitudinal axis to a second released condition wherein the second arrow rest portion is completely separated from the first arrow rest portion;

wherein the second arrow rest portion:

1) is slidably mountable on the arrow shaft;

2) slides along the arrow shaft from a forward shaft position to a rearward shaft position at least upon firing the arrow from the archery bow in the first captured condition; and 3) completely separates from the first arrow rest portion in a forward direction along the longitudinal axis during forward movement of the arrow at least during shooting to thereby move the second arrow rest portion from the first captured condition to the second released condition while retaining the second arrow rest portion on the arrow shaft a retrieval line connected between the archery bow and the second arrow rest portion;

wherein the arrow shaft slides through the second arrow rest portion upon release of the arrow during shooting until the stop contacts the second arrow rest portion while in the first captured condition and completely separates the second arrow rest portion from the first arrow rest portion to thereby move the second arrow rest portion from the first captured condition to the second released condition, whereupon the second arrow rest portion travels with the arrow to thereby enable retrieval of the arrow by pulling back on the retrieval line.

13. An archery assembly according to claim 12, wherein the second arrow rest portion comprises:

an inner hub;

a bore extending through the inner hub for slidably receiving the arrow shaft;

an outer wall surrounding the inner hub;

at least one spoke extending between the inner hub and outer wall; and at least one gap formed between the inner hub and the outer wall.

14. An archery assembly according to claim 13, wherein the retrieval line has opposite ends, with one end thereof having at least one loop that wraps around the at least one spoke and is secured thereto for retrieving the arrow after it has been shot.

15. An archery assembly according to claim 14, wherein the at least one spoke comprises first, second, third, and fourth spokes extending radially outwardly from the inner hub toward the outer wall; and the at least one gap comprises first, second, third, and fourth gaps located between the spokes; and wherein the at least one loop comprises:

a first end portion of the one end of the retrieval line extending forwardly through the first gap and the first spoke to thereby form a first loop oriented forwardly;

a second end portion of the retrieval line extending rearwardly through the second gap and arounf the second spoke to thereby form a second loop oriented rearwardly;

a third end portion of the retrieval line extending forwardly through the third gap and around the third spoke to thereby form a third loop oriented forwardly; and a fourth end portion of the retrieval line extending rearwardly through the fourth gap such that the first end portion extending through the fourth gap are seperated by the fourth spoke;

wherein the fourth end portion is connected to the retrieval line at a position spaced from the first end portion to thereby secure the retrieval line to the second arrow rest portion.

* * * * *